United States Patent [19]

Nielsen

[11] 4,405,257

[45] Sep. 20, 1983

[54] SAFETY MAT FOR USE IN PROTECTION OF WATERWASHED AREAS AGAINST EROSION AND/OR UNDERMINING

[75] Inventor: Erik Nielsen, Frederikshavn, Denmark

[73] Assignee: Daekko Presenning Kompagni A/S, Broenshoej, Denmark

[21] Appl. No.: 227,105

[22] PCT Filed: May 1, 1980

[86] PCT No.: PCT/DK80/00027

§ 371 Date: Dec. 22, 1980

§ 102(e) Date: Dec. 22, 1980

[87] PCT Pub. No.: WO80/02436

PCT Pub. Date: Nov. 13, 1980

[30] Foreign Application Priority Data

May 3, 1979 [DK] Denmark ..... 1828/79
Apr. 22, 1980 [DK] Denmark ..... 1718/80

[51] Int. Cl.[3] ..... E02B 3/12
[52] U.S. Cl. ..... 405/19; 405/18
[58] Field of Search ..... 405/16–34

[56] References Cited

U.S. PATENT DOCUMENTS

| | | | |
|---|---|---|---|
| 984,121 | 2/1911 | Condie | 405/18 |
| 2,047,197 | 7/1936 | Fordyce | 405/19 |
| 3,474,626 | 10/1969 | Colle | 405/18 |
| 3,561,219 | 2/1971 | Nishizawa et al. | 405/19 |
| 3,696,623 | 10/1972 | Heine et al. | 405/19 |
| 3,837,169 | 9/1974 | Lamberton | 405/18 |
| 4,102,137 | 7/1978 | Porraz et al. | 405/18 |

*Primary Examiner*—Dennis L. Taylor
*Attorney, Agent, or Firm*—Ladas & Parry

[57] ABSTRACT

A safety mat for protection against erosion and/or undermining consisting of a number of parallel tubular members containing a filling material and being interconnected by cross-binding ribbons placed at right angles to the tubular members. As filling material is used a granulated material of an average density of at least 1.6 Kg/dm$^3$, and the tubular members have a degree of filling of substantially 75%. Using a relatively heavy filling material that is introduced relatively loosely a mat is obtained having great flexibility, being able, therefore, to lie close up against even a domed bottom.

2 Claims, 9 Drawing Figures

Figure 1:
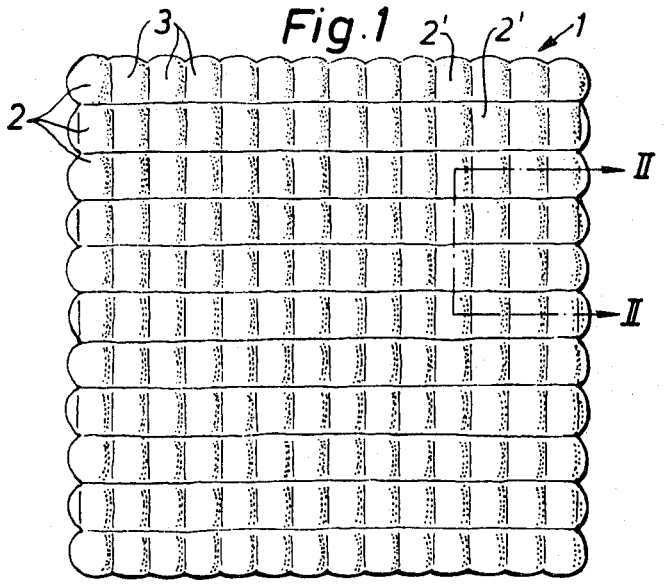

SAFETY MAT FOR USE IN PROTECTION OF WATERWASHED AREAS AGAINST EROSION AND/OR UNDERMINING

The invention relates to a safety mat used for protection of areas against erosion and/or undermining by the action of water, which mat consist of a number of parallel tubular members containing a filling material and being mutually connected by cross-binding ribbons placed at right angles to the tubular members and progessing about same forming a woven mat.

A safety mat of this type is known from the German published patent specification No. 2,762,692. In the case of this known mat the parallel casings or tapes are filled as tightly as possible, which hitherto has been considered the most appropriate, as it was desired to produce as heavy a mat as possible in order to avoid it being washed away.

However, it has turned out that this type of tightly filled mats is not a sufficiently effective protection of the waterwashed areas, as openings from between the hard and rigid casings making considerable passage of water possible from the upper side of the mat to the bottom side, whereby the material under the mat from time to time is washed away. The rigid casings are self-supporting and form a bridge over the pockets that are hollowed out under the mat by the washing away, and after some time the mat will rest on only a few tops. When a mat resting in this manner is exposed to a violent passage of water the mat will be torn away by the sea. This invention is based on a recognition of the above mentioned conditions with known safety mats, and the object of the invention is to design a safety mat which can be laid out directly on the area to be protected and which permanently and effectively protects against washing away.

According to the invention, this object is achieved by a safety mat of the type mentioned in the introduction and characterized in that the filling material is a granulated material of an average density of at least 1.6 kg/dm$^3$, and that the degree of filling of the tubular members is substantially 75%.

By using a filling material of a relatively large density (>1.6) which is introduced fairly loosely in the parallel tubular members (degree of filling ab. 75%) a mat is obtained that is heavy, but at the same time very flexible and capable of adopting the form of the bottom surface even if it should be a very domed surface. Even if when using such a mat a certain passage from the top to bottom should occur, this would not result in the aforementioned openings under the mat, as the yielding tubular members sink and contact the new bottom surface.

According to the invention the filling material can be a mixture of one or more relatively heavy materials and one or more relatively light materials. In this manner it will be possible, when laid out under water, to utilize the buoyancy of the water to administer to the mat a cross-sectional form appropriate for its particular use.

In a preferred embodiment the filling material is a mixture of pearl gravel and polystyrene granules. These easily acessible materials allow the passage of water and the grain size is sufficiently large to prevent them from penetrating a finely woven tubular member material at the same time preventing silting of the inside of the member.

According to the invention the pearl gravel can be placed at the ends of the tubular member, while the polystyrene is placed in the middle of the member. In this manner, the mat, when placed under water, as a result of the buoyancy will assume a reversed U-form in cross-section, and can therefore be used for protection of, for instance, tubular conduits laid out on the sea bed, or used to form a sort of tunnel on the sea bed.

In an embodiment preferred in practice the tubular members are provided with radially extending flaps situated diametrically opposite each other, said flaps being slightly pliable. It has been shown that these flaps rest against each other at two adjacent members, whereby a greater density is obtained in the mat and correspondingly greater security against the passage of water from the top to the bottom of the mat.

By providing for the cross-binding tapes being stressed and forming constructions in the tubular hose member, when dividing same into a number of cushion-formed pockets situated next to each other, a more flexible mat is obtained, the narrower areas acting as a kind of hinge between the filled cushion-formed pockets. At the same time the tightly stressed cross-binding tapes ensure greater density around the area between two adjacent tubular members.

According to the invention the tubular members may be of a material that is water-pervious but retains sand and earth. Consequently the mats can be laid out on dikes or similar places, where a natural vegetation is desired with no risk of silting up the tubullar members as a result of sand or earth penetrating into the filling material.

The invention will be further explained in the following with reference to the drawing, where FIG. 1 shows an upper view of mat laid out according to the invention, FIG. 2 a section along II—II of FIG. 1, FIG. 3 a section corresponding to II—II in FIG. 1, in another embodiment, FIG. 4 a longitudinal section through part of a tape or tubular member partly filled with a gravity material, FIG. 5 a section through a coast secured against erosion, FIG. 6 a section through a roadway, secured against sinking, FIG. 7 a section through a groyne, secured against erosion, FIG. 8 a section through a sea bed condiut, secured against washing away or surfacing, and FIG. 9 a section of a detail of a tubular member provided with flaps.

FIG. 1 is an upper view of the cross-woven safety mat 1 according to the invention and laid out on a horizontal base such as an earth surface for forming a stable foundation material for a roadway, path or bicycle track. The mat consists of two cross-woven tape systems 2,3, where, for example, the longitudinal tapes or chain tapes are flat tapes 3, while the transverse tapes or wefts are hollow tapes 2. In the embodiment shown, a hollow tape 2 with closed ends is used for each weft, and each of the hollow tapes 2 contains a gravity material or filling material 4 having a density of at least 1600 kg/dm$^3$. The gravity material 4 can consist of granulated stone, marine stone, such as pebbles, pea gravel, pearl gravel, granulated gravel or sand. The material 4, before the mat is placed, can also be dry sand to which has been added dry slowaction cement to which, after placing the mat, water is added for hardening.

The weight of the mat per area unit can be calculated using the hollow tape cross-sectional circumference and degree of filling, quantity of tapes per mat-unit lenght, or width, volumetric weight of the used density material, and the weight of the tape material used.

Figure 2:
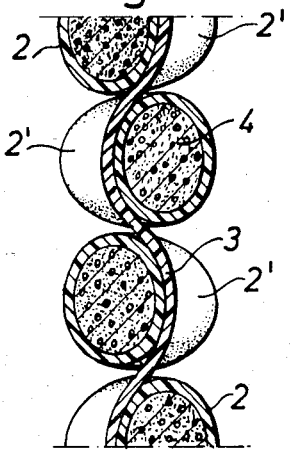

FIG. 2 shows a section of the mat cross-section laid out in warp direction, and from which appears the undulated form reached by the hollow tapes 2 by weaving the two tape systems.

Weaving the mat 1 shown in FIG. 1, a chess-board similar pattern of alternating domed and flat squares is obtained when filling degree of the hollow tapes 2 is below 100%, because of the mentioned undulating form of the two sides of the mat. The domed squares are formed by tape-sections fully or partly clamped or constricted by the flat tapes of the other tape system, said construction on the one hand giving the mat a flexibility or ability to adapt itself to the form of the bottom surface, and on the other hand preventing the density material from flowing from on tape section to another, e.g. when the mat is being transported or laid out, or should one of the tape sections be punctured.

A safety mat having a heavy volumetric weight can be had by being provided with tapes filled with gravity material in both warp and weft directions, but in that case the degree of filling in the tapes cannot be very high, at any rate not in the one tape system, partly due to the weaving operation and partly due to the desire to have a close weaving of the mat without noticeable mat openings between the tapes.

The tapes may be made of both long-lasting and short-lasting materials. Naturally, the long-lasting materials are appropriate, when the contents of the tapes are of a type of a easily shifted or easily washed away, and where the function of the mat has to last as long as possible. As examples of long-lasting tape materials can be mentioned glass fibres or durable plastic materials such as polyamide, polyester, polypropylene or polyethylene in filament form, such as cord or yarn, possible elongated before weaving or braiding to flat or hollow tapes, or in foil form, possibly perforated foil, of similar plastic materials which also after extrusion can be elongated before being formed into single layer or multilayer tapes on a flat or hollow form with or without the layer or layers being welded together. Woven or braided tape materials may also be given a tubular form by longitudinal stitching together, or heat welding. The last-mentioned method is especially advantageous where there is question of filling gravity material into very long hollow tapes. Plastic-covered steel wire web is an example of strong, long-lasting tape material. The flat tapes may also be replaced by plastic cords, synthetic rubber cords, or plastic-covered steel wires or steel wire rope.

In cases where the function of the safety mat is only to be temporary, or where the gravity material used after a certain period hardens to a cohesive whole, as is the case with gravity materials containing bitumen or cement, the short-lasting tape materials are appropriate. In the latter case, if safety is to be maintained, either one of the tape systems must be of long-lasting material, or both tape systems must be hollow tapes filled with gravity material, if there is a risk of displacement of the hardened filling material or deterioration of the hollow tapes. The following are examples of such materials that easily deteriorate: tapes made of polyvinyl chloride, plant or animal fibers, or, on a larger scale, iron and aluminium wire. In the case of gravity materials that can harden, reinforcement cords, wire, or netting can be introduced into such gravity materials.

Figure 3:
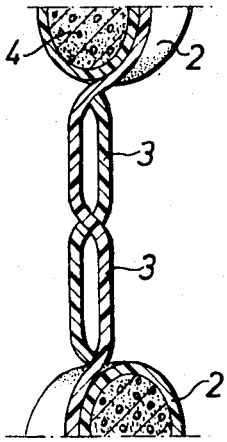

FIG. 3 is a cross section of a detail of a mat where, instead of tapes 2 filled with material, flatly applied or flat tapes 3 have been introduced in certain places in the mat, so that the distance between the filled tapes 2 is increased and at the same time the mat remains tightly woven. In this way the flexibility of the mat is increased and its volumetric weight is reduced.

Figure 4:
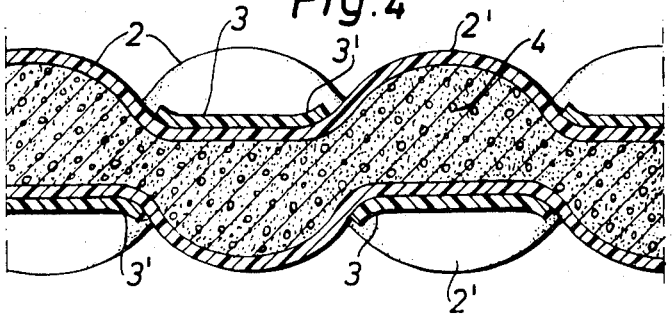

FIG. 4 shows a cut section through a partially filled hollow tape 2 clearly showing its undulated form. The edges 3' of the tranversal flat tapes 3 are seen to contribute to the local reduction of the cross-sectional area of the hollow tapes 2, the intermediate portions of gravity material in the bent or domed part 2' of the hollow tape being confined.

Some or all of the hollow tapes can be laid down flat individually during the weaving process, or by welding together or sewing during the filling process. This imparts to the mat areas a greater flexibility, besides which the volumetric weight is reduced. In the hollow tape of which a cross section is shown, stones can be placed to increase the draining ability of the mat. This draining ability can be further increased by using tapes having a larger mesh. At the same time this improves the possibility, if necessary, for vegetation to grow through the mat.

The special use of so-called ferro magnetic sand or gravel in the hollow tapes makes it possible, besides obtaining a high volumetric weight for a given mat, thus economizing on the tape material, to increase the ability of the mat to closely enfold iron constructions such as underwater pipe conduits or military material such as ships and hidden armoured vehicles, in which case the high content of refractory, shock-absorbing and shell-stopping materials can neutralize the effect of armour-penetrading weapons. In such cases the tape materials can include glass or asbestos fibers.

The most practical safety mat is pre-fabricated. The actual weaving of the pre-fabricated hollow tapes filled with gravity material in, for instance, a 5 m wide mat can be achieved by forming the tapes into lenghts of 5 m, 10.2 m, 15.2 m, and/or 20 to 30 m. The 10.2 m long tape can be introduced as weft from the right side of the loom and returned as the following weft from the left side. Then the 15.2 m long tape can be introduced as the next weft from the right side of the loom and the remaining part of the tape is returned a further two times, so that the last weft ends in the left side of the loom. The weaving is continued in this way until the desired lenght of mat is obtained. After fastening the mat ends, some of the flat tapes 3 can have loose ends extending from the mat for tying same to neighbouring mats. The same can be the case with the hollow tapes 2 that can have flat loose ends extending from the mat after sewing or welding.

If instead of using woven hollow tapes, use is made of braided hollow tapes, the cross-sectional circumference is reduced when these are strechted, and this will increase their grip around the filling material they contain and further increase the tightening effect from the edges of the transversal flat tapes. The effect is further encreased if the hollow tapes that are braided are made of an elastic material.

If the hollow tapes are woven on a circular loom, tapes are obtained having a regular cross-sectional circumference, and if these tapes are completely filled, they can brace the mat in the direction of the hollow tapes. If they are only partially filled the result is a very closely woven filter mat.

In order to protect the tape material from possible ultraviolet radiation with enusing deterioration, in cases where the material itself is not sufficiently long-lasting, an emulsion of bonding materials such as bitumen can be applied to the mat, for instance, and the bitumen is then covered by, for instance, drift sand while it is still damp.

Figure 5:
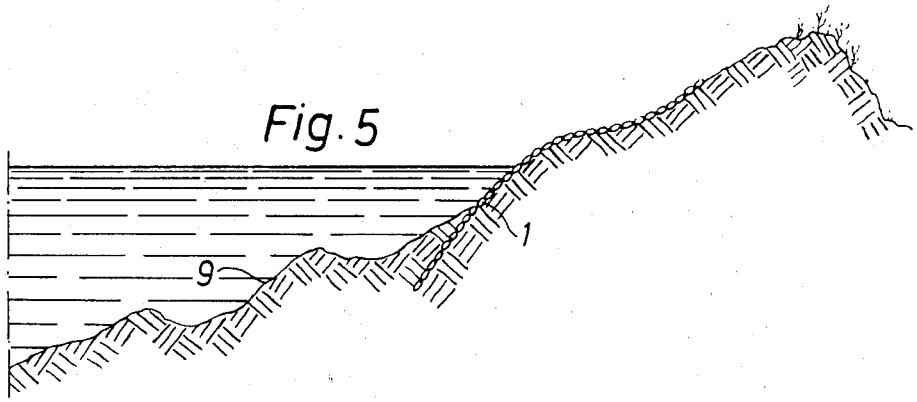

FIG. 5 shows an advantageous use of safety mat 1 in a rather heavy embodiment for securing coast lines or dikes, and where the mat is positioned such that it runs from below to above the local water level, and where the bottom part of the mat is buried in the bottom 9 of the water area. The mat is also suitable for use where there are sandy cores in the construction of piers. In a heavy embodiment, the mat can be used under covering stones, so that normal filter gravel is unnecessary.

Figure 6:
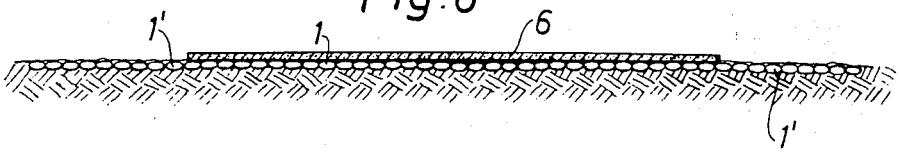

FIG. 6 shows mat 1 used as base for cycle tracks, paths or asphalted roads, and here a levelled area can be equipped with safety mats over which a layer of asphalt is placed without any or hardly any stabilizing gravel. In the embodiment shown the mat has at both ends thicker hollow tapes projecting beyond the asphalt part 1' to reinforce the side to an extent of for instance one meter.

Figure 7:
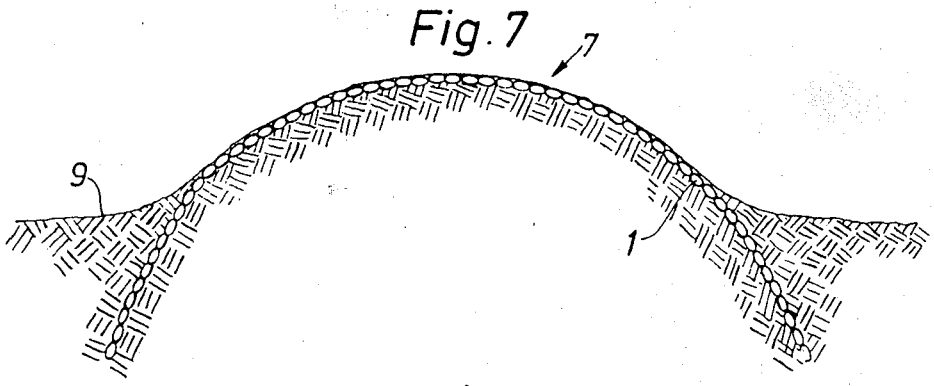

On beaches where erosion is not too violent, low groynes 7 can be erected simply and economically as shown in FIG. 7. After designing with a definite surface profile, having taken into account pedestrian and vehicle traffic, filter mats 1 are positioned as shown with the ends of the mats extending approximately one meter below the original level. There will be no noticeable settling problems, as the mat will follow a possible settling.

When securing the bottom in the ordinary way, the mats can be placed directly upon the eroded area without preparation or extra weighting, and when positioning light, the safety mats can be used instead of levelling shingle, the mats baing more effective with regard to preventing undermining.

The banks and bottom of canals and waterways can be protected using safety mats that are placed from bank, to bank following the profile of the canal.

Figure 8:
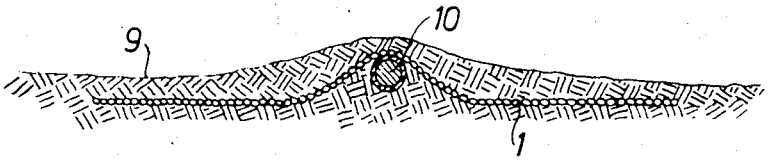

FIG. 8 shows a line 10, for instance a cable, a conduit or a pipe protected against undermining (washing away), surfacing or damage thorugh fishing tackle or damage through fishing tackle or anchors. The mat 1 is shown covered with silt, sandd or similar bed material that can settle after a certain time, but the mat is also designed to protect underwater installations in waters with strong currents, where such deposits do not take place. If sea currents undermine the edges of the mat, these just sink into the depressions formed and prevent the material lying under the installation from being removed. Instead of lying over the conduit 10 the mat can be placed under thus facilitating inspection of the conduit at the same time preventing undermining and thus providing a stable base.

Figure 9:
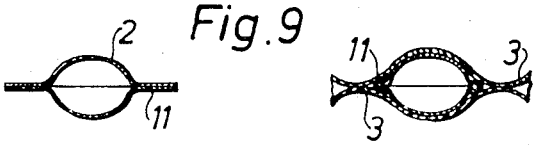

FIG. 9 shows that the tubular members or the tapes 2 can be equipped with flaps 11 situated diametrically opposite each other and curling together when the cross-sectional binding ribbons 3 are tightened, upon which the space between two adjoining tapes 2 filled throughout the total length of the tapes and correspondingly also under the cross-sectional binding ribbons.

Besides the pre-fabricated embodiment of the mat should be mentioned and endless embodiment assembled in situ with only partially filled hollow tapes having a length corresponding to width of the mat laid out. The mat-layer can be a vehicle or a ship the rear end or stern of which is equipped with a mat loom to which warp tapes are led from bobbins. The vehicle or ship has a store of hollow tape lengths placed manually or by machine successively in the loom from above between two or several sets of warp tapes depending on whether two-shaft or four-shaft weaving takes place. After each positioning of the hollow tape, the beams of the loom are reset and a new hollow tape is positioned. The weight of the woven hollow tapes with content keeps the flat tapes strechted and provides a tight, close weaving. When the mat being woven connects with the bottom of place of positioning along a certain lenght even tighter weaving can be achieved when the speed of movement of vehicle or ship is suitable adapted. Besides the hollow tapes, flat tapes or other materials can be woven in as weft depending on the required volumetric weight of the mat. Further stocks of mat material can be obtained from other ships or vehicles without interrupting the operation of the matlayer.

Hollow tapes having a cross-sectional circumference of 15 mm are suitable for thin, light safety mats, and such hollow tapes are mainly woven together with flat tapes having a width corresponding to the diameter of a distended hollow tape. When securing areas particularly exposed, for instance piers and coasts, hollow tapes having a cross-sectional circumference of up to 1200 mm and a flat tape width of up to 500 mm can be used. In most cases, however, the cross-sectional circumference and widths of flat tapes are in the region of 60 ro 400 mm respectively 20 to 150 mm. Instead of flat tapes, threads, cords or ropes parallel to each other can be used.

The invention is not limited to the features shown and described, and it must be noticed in particular that the tapes or the tubular members of the mat can be completely filled with polystyrene or a similar material.

What I claim is:

1. A safety mat for use in protection of waterwashed areas against ground deformation, wherein the mat includes a number of substantially parallel, elongated hollow members, tapes interconnecting said substantially parallel members and a filling material disposed within said hollow members, said filling material comprising a mixture of pearl gravel and granulated polystyrene with an average density of 1.6 kg/dm$^3$ and filling the tubular members to about 75 percent capacity with the pearl gravel disposed at the ends of the tubular members and the granulated polystyrene between the ends.

2. A safety mat according to claim 1, wherein the tapes are pre-stressed and form local constrictions in the tubular members.

* * * * *